US008277200B2

(12) United States Patent
Bona et al.

(10) Patent No.: US 8,277,200 B2
(45) Date of Patent: Oct. 2, 2012

(54) VARIABLE DISPLACEMENT COMPRESSOR WITH A DISCHARGE PRESSURE COMPENSATED SUCTION SHUTOFF VALVE

(75) Inventors: Joseph M. Bona, Willaimsville, NY (US); Matthew R. Warren, Buffalo, NY (US); Douglas E. Webster, Clarence, NY (US)

(73) Assignee: Delphi Technologies, Inc., Troy, MI (US)

( * ) Notice: Subject to any disclaimer, the term of this patent is extended or adjusted under 35 U.S.C. 154(b) by 649 days.

(21) Appl. No.: 12/466,603

(22) Filed: May 15, 2009

(65) Prior Publication Data

US 2009/0311109 A1 Dec. 17, 2009

Related U.S. Application Data

(60) Provisional application No. 61/132,287, filed on Jun. 17, 2008.

(51) Int. Cl.
*F04B 43/12* (2006.01)

(52) U.S. Cl. ..... 417/53

(58) Field of Classification Search ..... 417/53, 417/279, 559

See application file for complete search history.

(56) References Cited

U.S. PATENT DOCUMENTS

2008/0199328 A1* 8/2008 Hayashi et al. ..... 417/295

FOREIGN PATENT DOCUMENTS

| | | |
|---|---|---|
| EP | 0857874 | 8/1998 |
| EP | 0881387 | 12/1998 |
| EP | 0992684 | 4/2000 |
| EP | 1001170 | 5/2000 |
| EP | 1591661 | 11/2005 |
| WO | 2007/013244 | 2/2007 |

* cited by examiner

*Primary Examiner* — Anh Mai
*Assistant Examiner* — Andrew Coughlin
(74) *Attorney, Agent, or Firm* — Lawrence D. Hazelton

(57) ABSTRACT

A variable displacement compressor with a discharge pressure compensated suction shutoff valve (SSV). The SSV prevents noise generated at low refrigerant flow rates by a suction valve from propagating out of the compressor and to an air conditioner evaporator by variably restricting a fluid communication with the suction valve. The SSV is configured so the variable restriction is increased correspondingly with the discharge pressure if the discharge pressure is less than a threshold that is an indicator of low refrigerant flow rates, and the restriction is decreased if the discharge pressure is greater than the threshold.

8 Claims, 5 Drawing Sheets

VARIABLE DISPLACEMENT COMPRESSOR WITH A DISCHARGE PRESSURE COMPENSATED SUCTION SHUTOFF VALVE

This application claims the benefit of U.S. Provisional Application No. 61/132,287 filed Jun. 17, 2008.

TECHNICAL FIELD OF INVENTION

The invention relates to a variable displacement compressor having a suction shutoff valve (SSV) that impedes noise generated by the compressor from reaching the evaporator, and a method of controlling a compressor having a SSV. More particularly, the SSV provides a variable restriction that increases the restriction in response to increasing discharge pressure if the discharge pressure is less than a threshold, and decreases the restriction if the discharge pressure is greater than the threshold.

BACKGROUND OF INVENTION

Automobiles have air conditioners for reducing the temperature of air in an automobile passenger compartment. The air conditioner operates by compressing refrigerant using a compressor, reducing the temperature of the compressed refrigerant, and then expanding (uncompressing) the refrigerant to reduce the refrigerant temperature. The expanded refrigerant then flows through an evaporator used to lower the temperature of the air in the passenger compartment. Variable displacement compressors adjust a compressor's displacement to varying a compressor's refrigerant discharge flow and thereby reduce energy consumption by the compressor during certain operating conditions. Under low refrigerant flow conditions, a suction valve in the compressor can flutter and thereby create pressure pulsations that propagate into the air conditioner evaporator. These pressure pulsations may be heard inside the vehicle passenger compartment.

Some variable displacement compressors have a suction shutoff valve (SSV) to restrict or prevent suction flutter noise, sometime known as suction reed valve noise, from communication from the suction valve to the evaporator. However, a SSV providing adequate restriction at low flow conditions has undesirable flow restriction and pressure loss at high flow rates. At high flow rates it is advantageous to minimize the restriction of refrigerant flow to maximize compressor efficiency. What is needed is a SSV that has adequate restriction to prevent noise propagation out of the compressor at low refrigerant flow rates and reduced restriction at high refrigerant flow rates so that compressor efficiency is increased.

SUMMARY OF THE INVENTION

The subject invention provides a variable displacement air conditioning compressor having a suction valve capable of generating noise during low refrigerant flow conditions, and a suction shutoff valve (SSV) configured to provide a variable restriction sufficient to prevent the noise from propagating out of the compressor to an evaporator. The compressor also has a regulator valve in fluid communication with a discharge region containing refrigerant at a discharge pressure, wherein the regulator valve cooperates with the SSV to increase the variable restriction if the discharge pressure is indicative of a low refrigerant flow rate, and decrease the variable restriction if the discharge pressure is not indicative of a low refrigerant flow rate.

The regulator valve variably restricts fluid communication between the discharge region and an internal suction region for controlling or regulating the pressure of refrigerant in a regulated region to a regulated pressure, whereby the regulated pressure influences the variable restriction of the SSV. Discharge pressure is normally the highest pressure refrigerant in an operating air conditioner. By utilizing refrigerant from the discharge region during low flow, the restriction of the SSV can readily provide sufficient restriction to prevent noise propagation. However, at high refrigerant flow rates the influence of the discharge pressure would cause undesirable restriction. The subject invention overcomes this problem by blocking fluid communication between the regulated region and the discharge region if the discharge pressure or the discharge pressure minus the internal suction pressure is above a threshold. When the regulator valve blocks fluid communication with the discharge pressure, the regulated pressure is substantially equal to the internal suction pressure, and the restriction of the SSV is reduced.

The regulator valve has a valve body, a valve member, and a regulator spring, configured to allow refrigerant to pass from the discharge region to the regulated region for increasing the regulated pressure if the discharge pressure is less than a first threshold, thereby increasing the restriction of the SSV at low refrigerant flow rates, and prevent refrigerant passing from the discharge region for decreasing the regulated pressure if the discharge pressure is greater than the first threshold, thereby reducing the restriction of the SSV at high refrigerant flow rates.

The subject invention also provides a method of preventing noise generated at a low refrigerant flow rate by a suction valve from propagating out of the compressor, and reducing the restriction of the SSV at high refrigerant flow rates. The method includes the steps of increasing the variable restriction in response to the discharge pressure indicating low flow such that the noise is prevented from propagating out of the compressor, and decreasing the variable restriction in response to the discharge pressure not indicating low flow such that the efficiency of the compressor is increased at high flow rates.

Further features and advantages of the invention will appear more clearly on a reading of the following detail description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
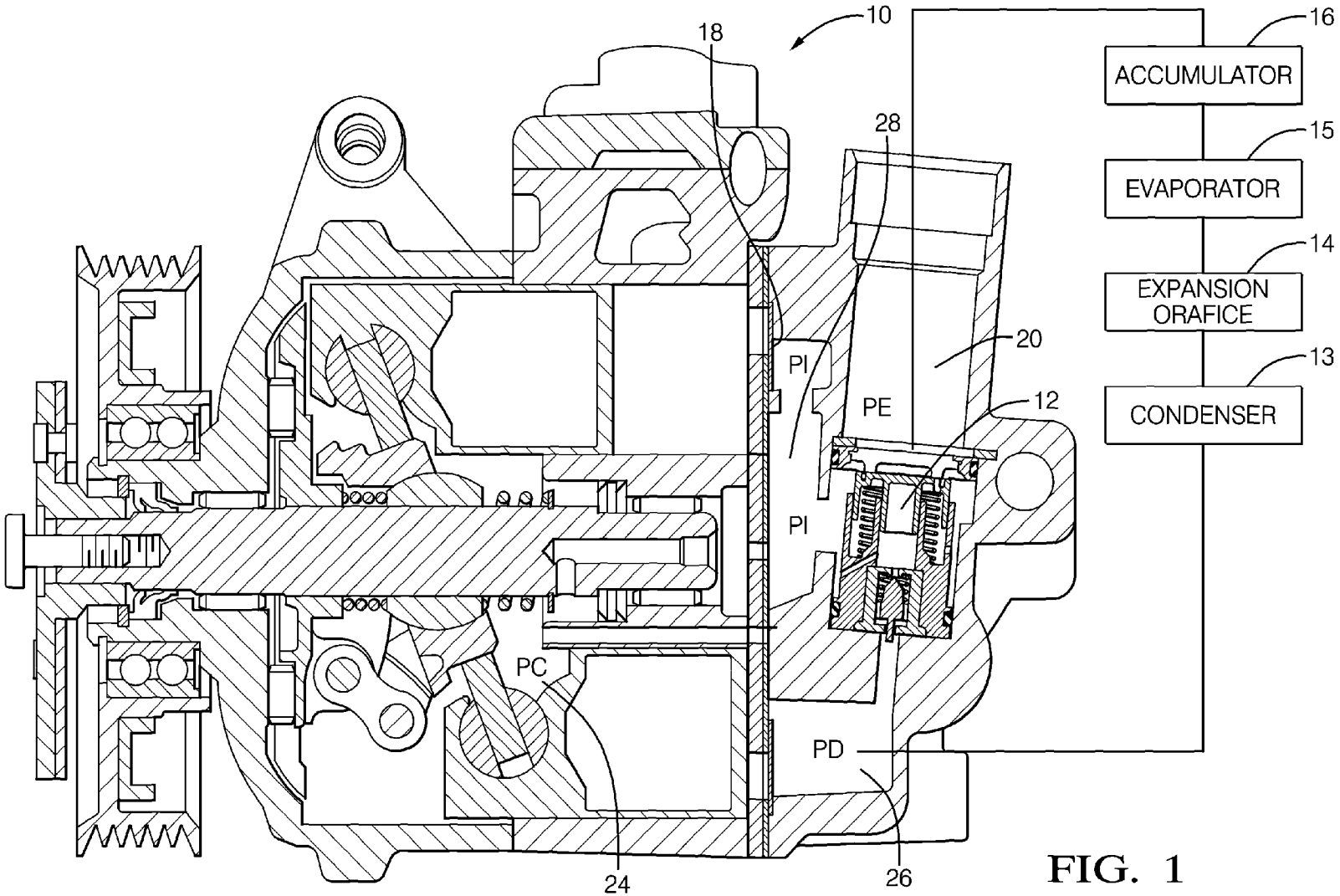
FIG. 1 is a cross sectional view of a variable displacement compressor having a suction shutoff valve (SSV)

In accordance with a preferred embodiment of this invention, FIG. 1 shows a variable displacement compressor 10 suitable for use in a vehicle air conditioner. The air conditioner cools air circulating into a vehicle passenger compartment. The compressor 10 may define a crankcase region 24 containing refrigerant at a crankcase pressure PC. Refrigerant compressed by the compressor is discharged at a discharge flow rate into a discharge region 26 containing refrigerant at a discharge pressure PD. The compressed refrigerant then flows to a condenser 13 to reduce the temperature of the compressed refrigerant, and then through an expansion orifice 14 to reduce the pressure of the refrigerant, thereby reducing the temperature of the refrigerant, and cooling evaporator 15. Refrigerant warmed by exchanging heat from air destined for the passenger compartment exits the evaporator 15, returns to the compressor 10 via an accumulator 16, and is drawn into a suction region of the compressor 10. A suction shutoff valve (SSV) 12 segregates the suction region into an external suction region 20 containing refrigerant at an external suction pressure PE and an internal suction region 28 containing refrigerant at an internal suction pressure PI. Refrigerant flows from the accumulator 16 through the external suction region 20, through the SSV 12, into the internal suction region 28, and then through a suction valve 18 that acts as a one-way valve for refrigerant about to be compressed. Compressor 10 is a variable displacement type compressor that provides a variable refrigerant discharge flow rate. The suction valve 18 is capable of generating noise due to suction valve flutter, particularly when the flow rate is at the lower end of the range of possible flow rates. The suction valve 18 is sometimes a reed valve and the noise is sometimes called reed flutter noise or suction reed valve noise.

The compressor 10 may be an external-control type that requires an external signal to adjust the variable displacement, or the compressor 10 may be an internal-control, a pneumatic type that is self-adjusting, or a hybrid combination of the two types. The absolute value of the discharge pressure PD, the difference between the discharge pressure PD and some reference pressure, and the difference between the discharge pressure PD and the internal suction pressure PI (PD-PI) are all indicators of the status of a cooling system. Using PI as the reference pressure for determining PD-PI as the status indicator simplifies the hardware necessary to monitor the status. The low end of the range of possible values of PD-PI is indicative of either the cooling system just starting operation, in which case the refrigerant pressures throughout the air conditioning system are substantially equal, or indicative of the system being subject to a low operating load, such as could occur on a cooler or moderate temperature day. The high end of the range of possible values of PD-PI indicates that the operating load is relatively high, such as could occur on a hot day. If the operating load is low, then the refrigerant flow requirements are also low.

Figure 2:
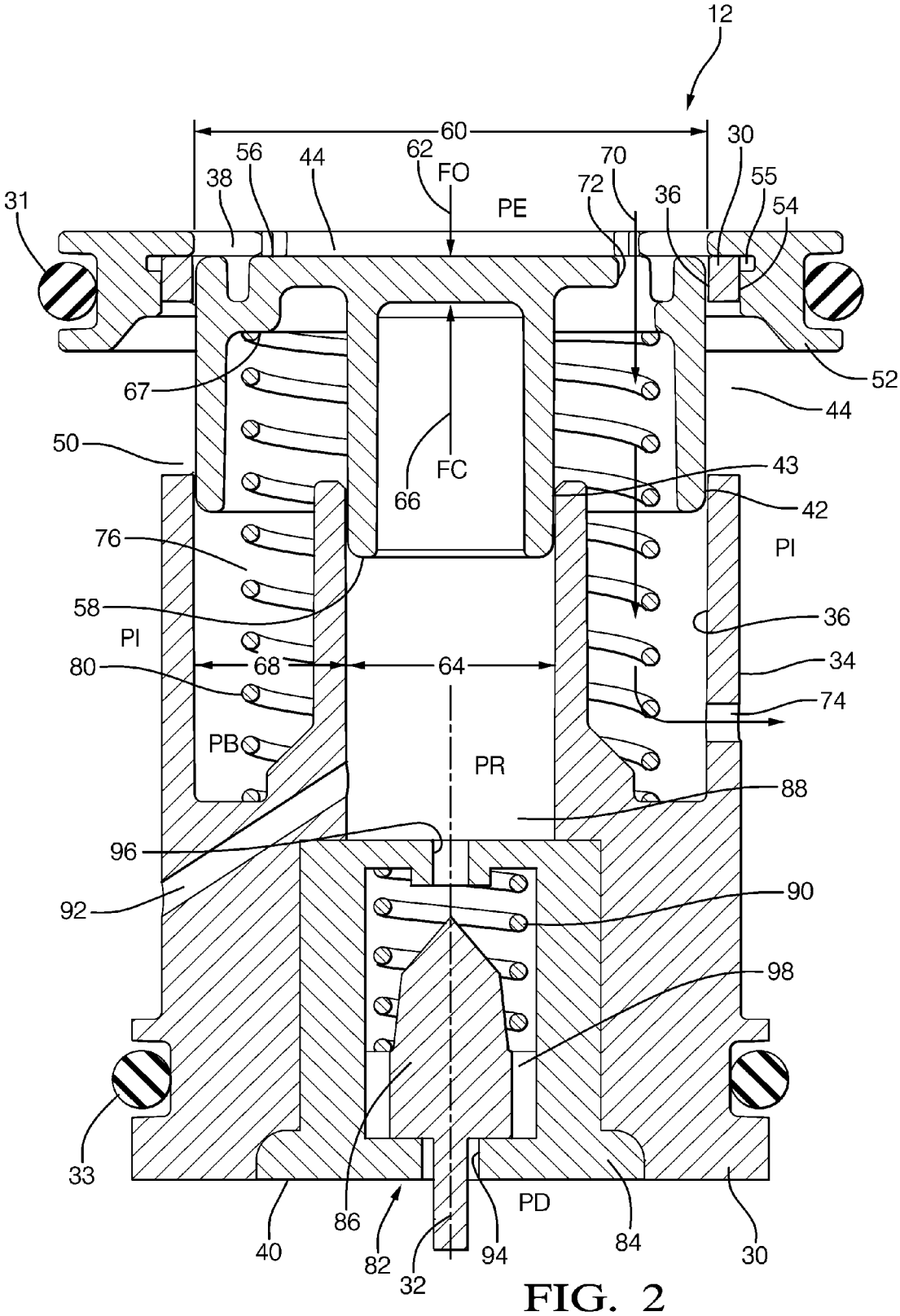
FIG. 2 is a cross sectional view of the SSV in FIG. 1.

Referring now to FIG. 2, SSV 12 has a housing 30 that is generally cylindrical in shape and defines a longitudinal axis 32 through the center of the cylindrical shape. The housing 30 has an outer surface 34 exposed to refrigerant in the internal suction region 28 at an internal suction pressure PI, and an inner surface 36. The housing 30 has a first end portion 38 exposed to refrigerant in the external suction region 20 at the suction pressure PE, a second end portion 40 exposed to refrigerant from the discharge region 26 at the discharge pressure PD. An O-ring 31 and an O-ring 33 seal against features between compressor 10 and housing 30 to prevent unregulated refrigerant flow between the various regions containing refrigerant at the various pressures. A piston 50 is configured to slide sealingly along an inner sealing region 43 arranged radially about the longitudinal axis 32. The inner sealing region 43 helps to prevent unregulated refrigerant flow between the various regions. The first end portion 38 has at least one opening 44 through the housing 30 for providing a fluid communication path for refrigerant to flow between the external suction region 20 and the internal suction region 28.

Figure 3:
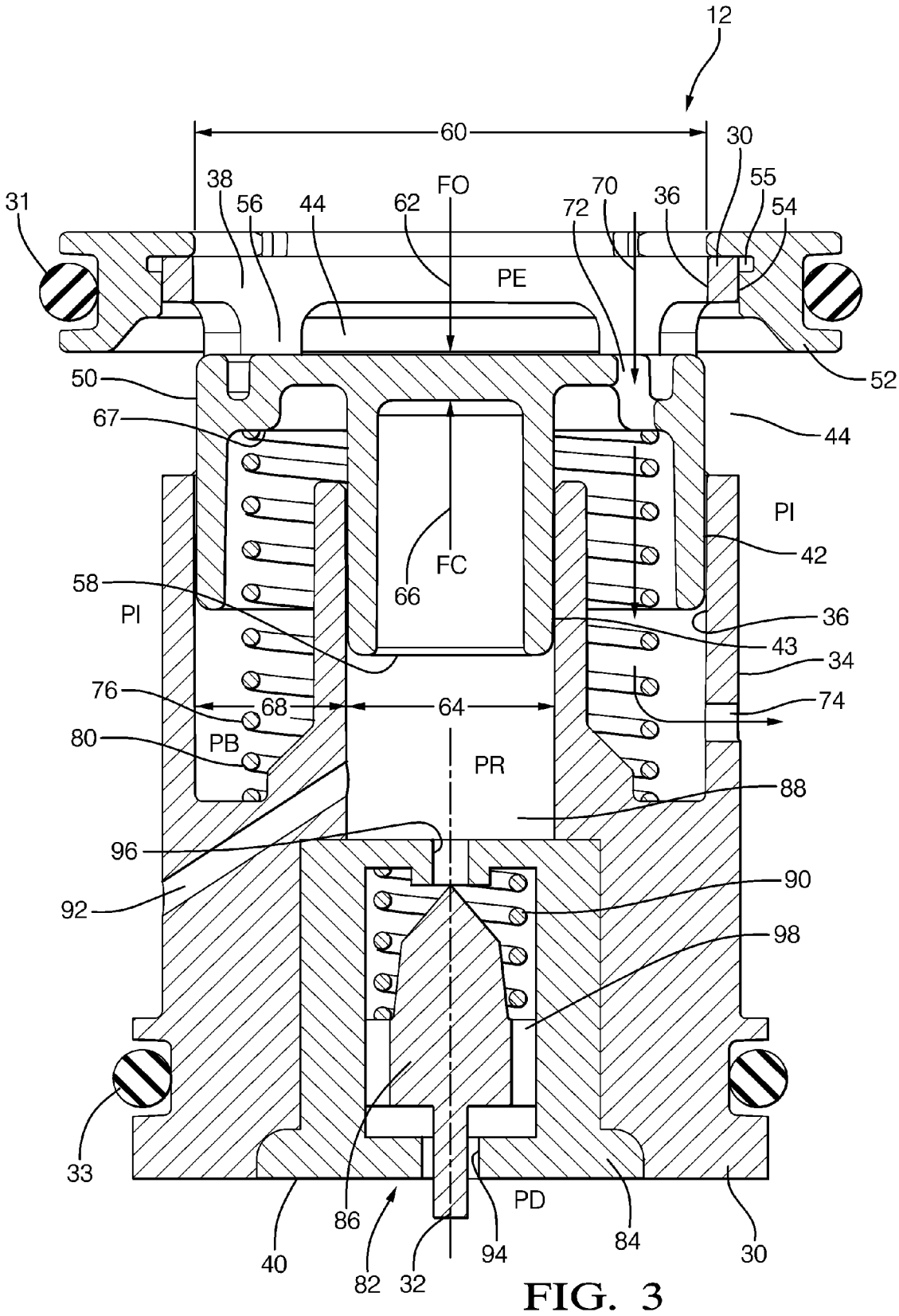
FIG. 3 is a cross sectional view of the SSV in FIG. 1.
Figure 4:
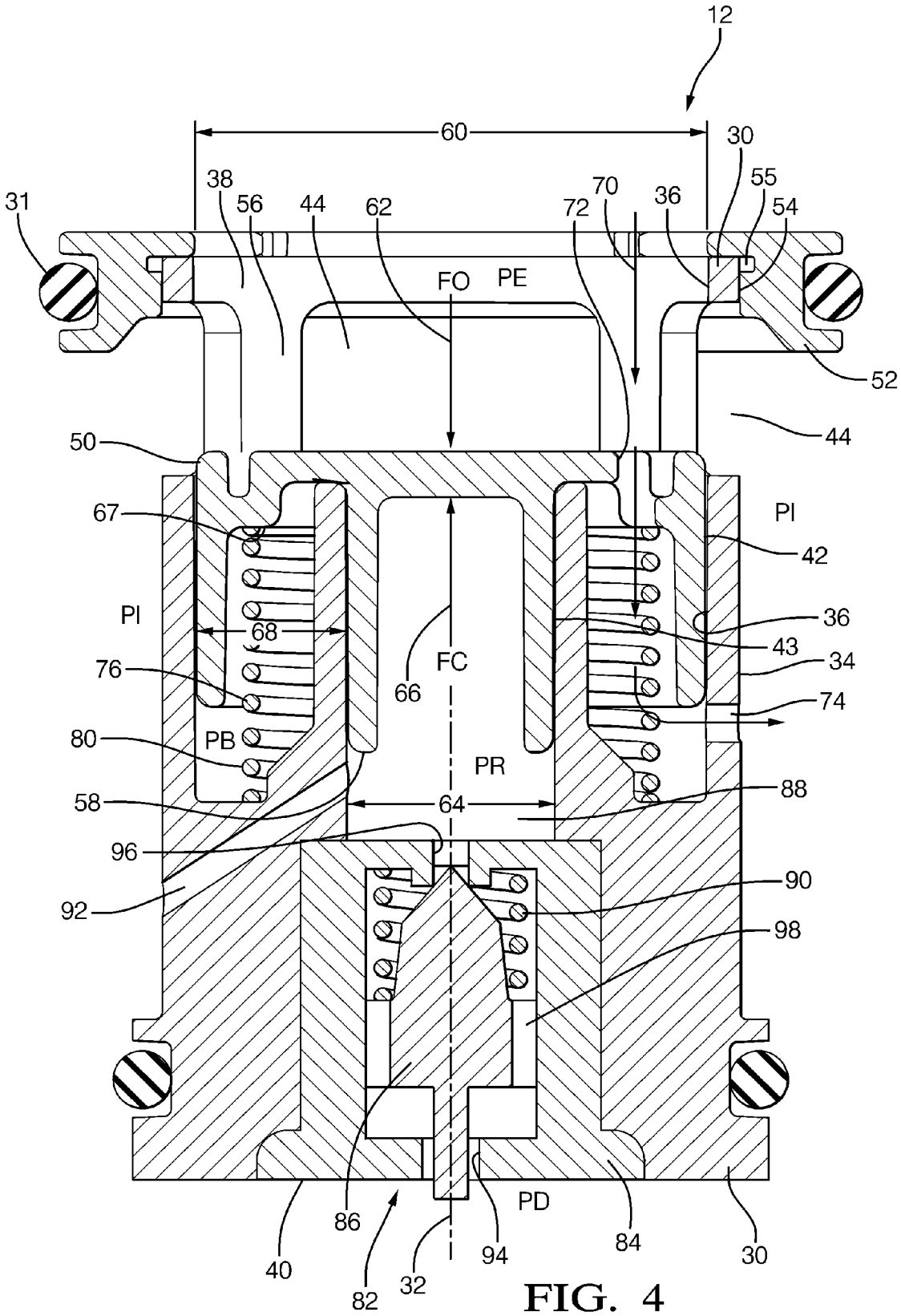
FIG. 4 is a cross sectional view of the SSV in FIG. 1.

The piston 50 is configured to engage features of the first end portion 38 for creating a variable obstruction to refrigerant flowing through the opening 44, and thereby establishing a restriction on fluid communication and noise communication between the external suction region 20 and the internal suction region 28. FIG. 2 shows the SSV 12 as closed such that the piston 50 is positioned to cause the greatest obstruction of the opening 44. FIG. 3 shows the SSV 12 as partially open such that the piston 50 is in an intermediate position, thereby partially obstructing opening 44. FIG. 4 shows the SSV 12 as open such that the piston 50 is positioned to cause the least obstruction of the opening 44. When the SSV is closed or nearly closed, the restriction on fluid communication between the internal suction region 28 and the external suction region 20 is sufficient to prevent noise generated by suction valve 18 from propagating to evaporator 15. The housing 30 and the piston 50 are configured and arranged so that the piston 50 can move to create a variable obstruction of opening 44 and thereby vary the variable restriction of the SSV.

Referring again to FIG. 2, the piston 50 is arranged in the first end portion 38 of the housing 30 and is retained in the housing 30 by a retainer 52 fixedly coupled to the housing 30 at interface surface 54. The housing 30 and the retainer 52 are preferably coupled at the interface surface 54 by a snap fit feature 55, because snap fitting parts together is considered to be an economical and reliable process. Alternately, the attachments could be made by gluing, laser welding, ultrasonic welding, or friction welding. The SSV 12 also has a regulator valve 82 arranged in a second end portion 40. The regulator valve 82 includes a regulator valve body 84, a valve member 86, a spring 90, and a restricted orifice 92. The regulator valve 82 is shown as being integrated into the housing 30 of the SSV 12 in a manner effective to define a regulated pressure cavity 88 containing refrigerant at a regulated pressure PR. Alternately, the regulator valve could be located remote from the SSV and coupled to the regulated pressure cavity 88 by way of a tube or some other means of fluid communication. The restricted orifice 92 provides both a pressure source to act as a reference for comparing to the discharge pressure PD and a source of lower pressure refrigerant so the regulated pressure PR can be controlled to a range of pressures. Valve body 84 is shown as a separate piece distinct from housing 30 for the purposes of illustration. Alternately, valve body 84 could be formed integrally with housing 30 and reduce the number of parts. Persons skilled in the art will recognize that the valve body and valve member could be a variety of shapes or configurations. By way of example, valve member 86 could be replaced with a ball. The housing 30, the retainer 52, the piston 50, the valve body 84, and the valve member 86 are preferably made of a polymer suitable for exposure to refrigerant. Alternately, the parts may be made of a metal or ceramic.

The piston 50 has a first face 56 defining a first face area 60 at one end of the piston, a second face 58 axially opposed to the first face 56 and defining a second face area 64, and a third face 67 having an annular shape concentric with and radially separated from, but adjacent to the second face area 64 and defining a third face area 68. An exemplary diameter of the first face 56 is 15 millimeters, so an exemplary first face area 60 is about 177 millimeters-squared. An exemplary diameter of the second face 58 is 8 millimeters, so an exemplary second face area 64 is about 50 millimeters-squared. The absolute size and relative sizes of each piston face areas 60, 64, and 68 are selected to provide desirable operating characteristics of the SSV 12 such as the desired variable restriction when various pressures are present. The arrangement of the piston 50 and the housing 30 cooperate to define a bleed cavity 76 containing refrigerant at a regulated pressure PB. Based on the exemplary face area values given above, an exemplary third face area 68 is about 127 (177-50) millimeters-squared.

The first face 56 is acted upon by refrigerant at the external suction pressure PE, the second face 58 is acted upon by refrigerant in the regulated pressure cavity 88 at the regulated pressure PR, and the third face is acted upon by refrigerant in a bleed cavity 76 at the bleed pressure PB. Refrigerant at the external suction pressure PE acting over the first face area 60 generates an opening force 62 (FO). Refrigerant at the regulated pressure PR acting over the second face area 64 and refrigerant at the bleed pressure PB acting over the third face area combine constructively to generate a closing force 66 (FC) in opposition to the opening force 62. A balance of forces including the opening force 62 and the closing force 66 influences the position of piston 50 within housing 30 for determining the degree of obstruction of opening 44.

The configuration of the piston 50 and the housing 30 is such that the value of the first face area 60 is approximately equal to the value of the second face area 64 combined with the value of the third face area 68. Alternative configurations for piston 50 and housing 30 include increasing the diameter of the second face 58 to equal the diameter of the first face 56, thereby eliminating the third face 67 and the bleed cavity 76. Alternative piston configurations include having two separate pieces defining the first face 56 and the second face 58 and the faces coupled by a spring (not shown). As illustrated in FIG. 2, the first face 56 and second face 58 are rigidly coupled to each other. When compared to piston assemblies where the opposing faces are coupled together by a spring, having the faces 56 and 58 rigidly coupled is advantageous because the number of parts in the SSV 12 is reduced and the degree of obstruction of valve opening 44 is more directly influenced by PR. Another alternative configuration for the piston 50 is to have the outer sealing region 42 moved radially outward or inward such that the combined values of the second face area 64 and the third face area 68 could be greater or less than the first face area 60. Additionally, the outer seating region 42 could be moved inward such that a fourth area is created (not shown) that undercuts and is opposed to the first face area 60 and would be exposed to refrigerant at pressure PI. Having the option to vary the relationships between the various face areas is advantageous for tuning various performance characteristics of the SSV 12.

The regulated pressure cavity 88 containing refrigerant at the regulated pressure PR is in fluidic communication with the internal suction region 28 through a restricted orifice 92. The regulated pressure cavity 88 is also in variably restricted fluidic communication with the discharge region 26 via the regulator valve 82. As can be seen in FIGS. 2-4, the path through the regulator valve 82 includes an inlet orifice 94, a gap 98, and an outlet orifice 96. If the pressure difference PD-PI is greater than a first threshold, then as illustrated in FIG. 4, the valve member 86 obstructs the outlet orifice 96 so the regulated pressure PR in the regulated pressure cavity 88 will be substantially equal to the internal suction pressure PI. If the pressure difference PD-PI is less than a second threshold that is less than the first threshold, then as illustrated in FIG. 2, the spring 90 urges the valve member 86 to a position so the valve member 86 obstructs the inlet orifice 94 and the regulated pressure PR in the regulated pressure cavity 88 will again be substantially equal to the internal suction pressure PI. It is advantageous to block the flow of refrigerant through the regulator valve when the compressor is not operating for discharging refrigerant, particularly if the compressor is a clutch less variable displacement type.

Figure 5:
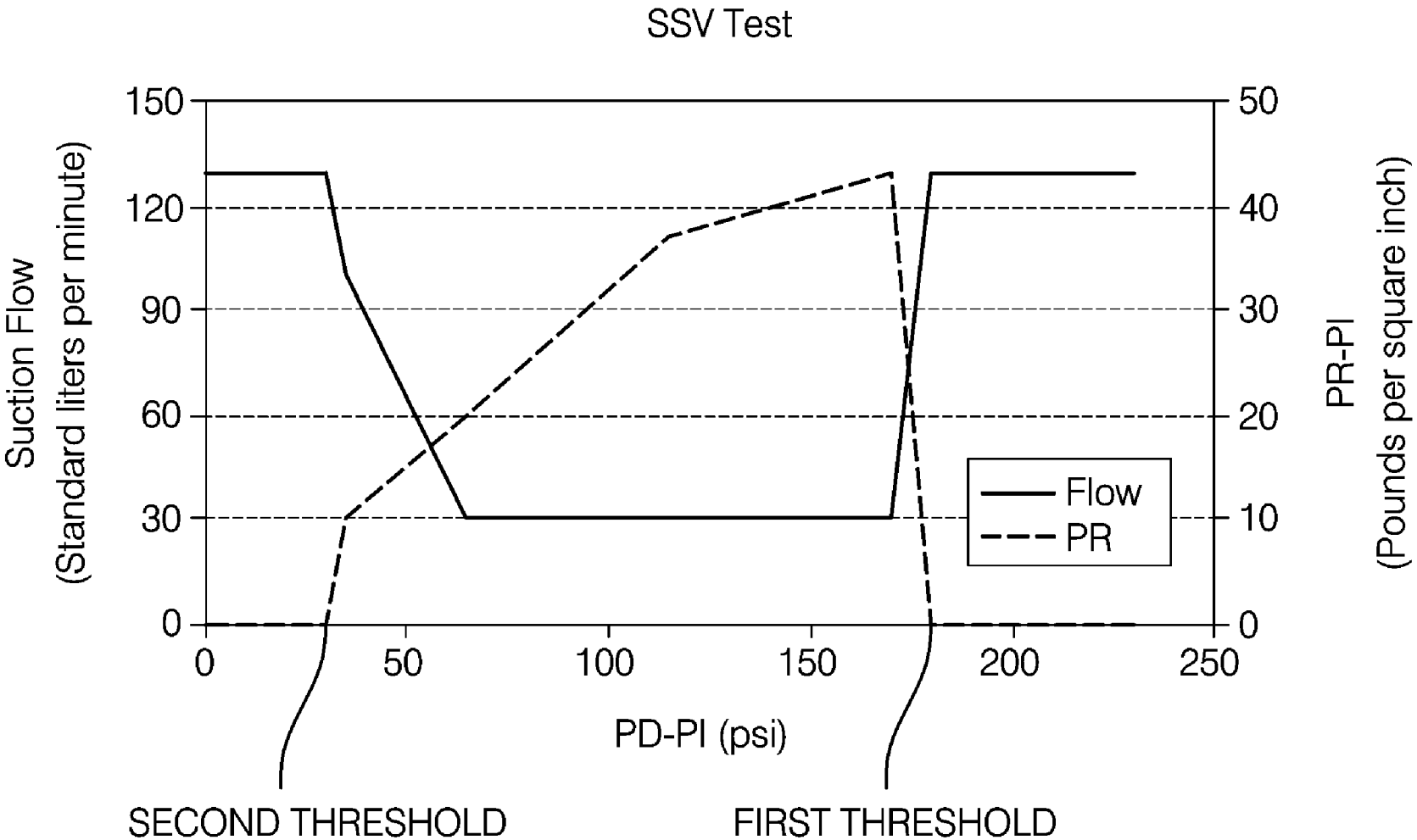
FIG. 5 is a graph illustrating the operation of the SSV in FIGS. 2-4.

FIG. 5 illustrates the operating characteristics of an SSV having a regulator valve similar to FIGS. 2-4 during a test. The test exposes the outer surface 34 to atmospheric pressure to establish the internal suction pressure PI at atmospheric pressure, applies an air pressure of about 7 p.s.i.g. to external suction pressure PE, and then applies a variable pressure source of air to discharge pressure PD. As PD is varied, the regulated pressure PR relative to PI and the rate of suction flow from PE to PI are measured. From the graph, if PD-PI is less than about 30 p.s.i., the flow rate is relatively unrestricted since the restriction of the SSV is not being influenced by the discharge pressure PD. For PD-PI less than about 30 p.s.i., the valve member 86 is in the position shown in FIG. 2, and thus an exemplary value for the second threshold is 30 p.s.i. When PD-PI is greater than about 30 p.s.i., but less than about 160 p.s.i., the valve member 86 moves away from the inlet orifice 94 to an intermediate position similar to that shown in FIG. 3. For this condition, PR-PI is increased so the piston 50 is urged to increase the obstruction of opening 44 and increase the variable restriction of the SSV, thereby reducing the suction flow as shown in the graph. When PD-PI is greater than about 170 p.s.i., the valve member 86 moves to the position shown in FIG. 4 and blocks fluid communication between PR and PD. As shown in the graph, PR-PI drops to zero and the suction flow is again relatively unrestricted.

The refrigerant in the regulated pressure cavity 88 has a regulated pressure PR. PR is determined by the variable restriction through the restricted orifice 92 and the regulator valve 82. For a given set of operating conditions, if the variable restriction of the restricted orifice 92 is substantially greater than the variable restriction of the regulator valve 82, then PR will be substantially equal to PD. Conversely, if the restriction of the restricted orifice 92 is substantially less than the degree of restricting of the regulator valve, then PR will be substantially equal to PI. It follows that the degree of restricting of the regulator valve can be controlled to regulate PR to any value between PD and PI. The spring rate and preload of the spring 90 and the sizes of the various orifice of the regulator valve 84 are tuned so that for a given compressor coupled to a given air conditioner in a given vehicle, the variable restriction of the SSV 12 is sufficient to prevent noise generated by the compressor from being heard in the passenger compartment.

In the embodiment shown, the SSV has a spring 80 arranged to bias the piston 50 in the closing direction. It is advantageous for the SSV 12 to be closed when the air conditioner is off or not active for discharging refrigerant to insure that the valve is closed when the compressor is reactivated. Furthermore, when the air conditioner is on and PR-PE differential is low, small perturbations in PR and PE can cause the piston 50 to generate audible noise. The spring 80 helps reduce the probability that piston 50 may generate noise. The spring rate of the spring 80 is selected as low as possible to minimize SSV restriction at high refrigerant flow rates, but large enough to overcome any piston to housing friction to assure that the SSV 12 is in the closed position when the air conditioner is not active. For the SSV 12 shown in FIGS. 2-4, an exemplary spring rate is 0.5 pounds per inch where the spring 80 is preloaded to about 0.1 pounds. Alternately, if the above issues regarding the need for the spring 80 were not deemed to be of concern, the spring 80 could be eliminated from the SSV.

In the embodiment shown, the housing 30 includes a housing bleed orifice 74 providing fluid communication between the internal suction region 28 and the bleed cavity 76, and a piston bleed orifice 72 providing fluid communication between the bleed cavity 76 and the external suction region 20. The fluid communication provided by the housing bleed orifice 74 and the piston bleed orifice 72 helps to regulate the bleed pressure PB in bleed cavity to prevent excessive delay in the opening of the SSV 12 in the event that there is a sudden change in PE, PI, or PR. The optimum size of the housing bleed orifice 74 the piston bleed orifice 72 is dependent on the desired response characteristics of the SSV and is influenced by the volume of the bleed cavity 76. For the exemplary SSV 12 shown in FIGS. 2-4, the size of the housing bleed orifice 74 is about 2 millimeters, and the size of the piston bleed orifice 72 is about 1 millimeter. A more complete description of bleed cavity 76 including the sizing of piston bleed orifice 72 and housing bleed orifice 74 forming refrigerant bleed path 70 can be found in US Patent Application Publication US 2009-0205347 by Cochran et al., published Aug. 20, 2009 which is hereby incorporated by reference.

As shown in FIGS. 2-4, the refrigerant bleed path 70 is between the external suction region 20 and the internal suction region 28. It is advantageous to have a bleed path to allow a minimum flow of refrigerant at all times. If the bleed path 70 is too restrictive then the compressor efficiency at low refrigerant flow rates is compromised. If the bleed path 70 is too large or unrestrictive, then suction reed pulsation noise may propagate to the evaporator at low refrigerant rates. Alternately, a bleed path can be provided by including a mechanical piston stop (not shown) to prevent piston 50 from completely blocking opening 44, or by increasing the radial piston clearance (not shown) between the piston 50 and the housing 30.

Thus, a variable displacement compressor having a suction shutoff valve (SSV) effective to prevent noise from propagating to the evaporator at low flow rates and exhibit reduced restriction to refrigerant flow at high refrigerant flow rates is provided. The SSV has a closing force generated by the regulated pressure PR acting upon the second face area increases SSV restriction if the pressure difference PD-PI is less than a first threshold being indicative of low refrigerant flow, and decreases the restriction if the pressure difference is greater than the first threshold being indicative of high refrigerant flow.

While this invention has been described in terms of the preferred embodiments thereof, it is not intended to be so limited, but rather only to the extent set forth in the claims that follow.

We claim:

1. A variable displacement compressor comprising:

a suction valve capable of generating a noise when the compressor is operating at low displacement;

a suction shutoff valve (SSV) for providing a variable restriction of fluid communication with the suction valve to prevent the noise from propagating out of the compressor, said variable restriction influenced by a regulated pressure;

a regulator valve that determines the regulated pressure by controlling fluid communication with a discharge pressure, wherein said regulator valve cooperates with the SSV for increasing the variable restriction when the discharge pressure is indicative of the compressor operating at low displacement for preventing the noise from propagating out of the compressor, and decreasing the variable restriction when the discharge pressure is indicative of the compressor operating at high displacement for improving compressor efficiency at high displacement, wherein the regulator valve is also in fluid communication with an internal suction pressure, whereby if a pressure difference of the discharge pressure minus the internal suction pressure is less than a first threshold, then the discharge pressure is indicative of the compressor operating at low displacement, and if the pressure difference of discharge pressure minus the internal suction pressure is greater than the first threshold, then the discharge pressure is indicative of the compressor operating at high displacement, wherein the suction valve is located in an internal suction region containing refrigerant at the internal suction pressure received from an external suction region containing refrigerant at an external suction pressure, and the variable restriction provided by the SSV variably restricts fluid communication between the internal suction region and the external suction region, a housing separating the internal suction region and the external suction region and defining an opening for fluid communication between the internal suction region and the external suction region;

a piston sliding sealingly within the housing, said piston having a piston position relative to the opening for variably obstructing the opening to vary the variable restriction; and a regulated region defined at least in part by the piston and the housing, said regulated region containing refrigerant at a regulated pressure, and said regulated pressure being influenced by the regulator valve, wherein the piston position is biased by the regulated pressure towards obstructing the opening, thereby increasing the variable restriction, wherein the regulator valve comprises a restricted orifice for providing restricted fluid communication between the internal suction region and the regulated region;

a valve body having an outlet orifice for providing fluid communication between the regulated region and a discharge region containing refrigerant at the discharge pressure;

a valve member arranged within the valve body, said valve member having a valve member position relative to the outlet orifice for variably obstructing the outlet orifice and thereby influencing the regulated pressure by variably restricting fluid communication between the regulated region and the discharge region; and a regulator spring for biasing the regulator valve such that the outlet orifice is not obstructed if the pressure difference is less the first threshold, and the outlet orifice is obstructed if the pressure difference is greater than the first threshold, wherein the restricted orifice, the outlet orifice and the spring are proportionately sized such that the regulated pressure is biased toward the discharge pressure if the pressure difference less than the first threshold, and the regulated pressure is biased toward the internal suction pressure if the pressure difference is greater than the first threshold, wherein the regulator valve fluid communication with the discharge region is through an inlet orifice and the regulator valve is further configured to block fluid communication between the discharge region and the regulated region if the pressure difference is less than a second threshold that is less than the first threshold, wherein the pressure difference being below the second threshold indicates that the compressor is not being operated for discharging refrigerant.

2. A compressor in accordance with claim 1, wherein the SSV further comprises:

a piston spring cooperating with the piston and the housing to urge the piston towards increasing the variable restriction.

3. A compressor in accordance with claim 1, wherein the SSV further comprises a bleed path providing restricted fluidic communication between the internal suction region and the external suction region, thereby limiting the variable restriction to a maximum.

4. A variable displacement compressor comprising:

a suction valve capable of generating a noise in an internal suction region when the compressor is operating at low displacement;

a suction shutoff valve (SSV) for providing a variable restriction of fluid communication with the suction valve to prevent the noise from propagating out of the compressor, said SSV including a housing defining a longitudinal axis, said housing comprising an outer surface exposed to refrigerant from an internal suction region at an internal suction pressure, and an inner surface having a first end portion exposed to refrigerant from an external suction region at an external suction pressure and a second end portion exposed to refrigerant from a discharge region at a discharge pressure, said first end portion having an opening through the housing between the inner surface and the outer surface for providing fluid communication between the external suction region and the internal suction region, said SSV further comprising a piston arranged in the first end portion and configured to variably obstruct the opening by sliding sealingly against the first end portion of the inner surface along the longitudinal axis for engaging the first end portion to cover the opening and provide a variable restriction upon the fluid communication between the internal suction region and the external suction region, said variable restriction capable of being sufficient to prevent the noise generated by the suction valve from propagating into the external suction region and out of the compressor when the discharge flow rate is low;

a regulator valve arranged in the second end portion, cooperating with the piston and the housing to define a regulated region therebetween, said regulator valve configured to regulate the pressure of refrigerant in the regulated region to a regulated pressure;

said piston comprising a first face exposed to refrigerant from the external suction region and defining a first face area, and a second face axially opposed to the first face, exposed to refrigerant from the regulated region, and defining a second face area, whereby an opening force generated by the external suction pressure acting upon the first face area that urges the SSV to decrease the variable restriction is opposed by a closing force generated by the regulated pressure acting upon the second face area that urges the SSV to increase the variable restriction;

a regulator valve in fluid communication with the discharge pressure, wherein said regulator valve cooperates with the SSV for increasing the variable restriction when the discharge pressure is indicative of the compressor operating at low displacement for preventing the noise from propagating out of the compressor, and decreasing the variable restriction when the discharge pressure is indicative of the compressor not operating at low displacement for improving compressor efficiency at high displacement; and a restricted orifice providing restricted fluid communication between the internal suction region and the regulated region for cooperating with the regulator valve to control the regulated pressure, wherein said regulator valve comprising a valve body, a valve member, and a regulator spring arranged to control refrigerant to passing from the discharge region to the regulated region, wherein the discharge pressure is indicative of the compressor operating at low displacement if the discharge pressure minus the internal suction pressure is less than the first threshold, whereupon the regulator valve is configured pass refrigerant from the discharge region to the regulated region to bias the regulated pressure toward the discharge pressure, thereby increasing the variable restriction, wherein the discharge pressure is indicative of the compressor operating at greater than low displacement if the discharge pressure minus the internal suction pressure is greater than a first threshold, whereupon the regulator valve is configured to obstruct refrigerant from the discharge region to bias the regulated pressure toward the internal suction pressure, thereby decreasing the variable restriction, wherein the piston and housing are configured to define a bleed cavity containing refrigerant at a bleed pressure, wherein the piston further comprises a third face defining a third face area exposed to refrigerant from the bleed cavity, whereby the bleed pressure acting upon the third face area is directed to supplement the closing force.

5. A compressor in accordance with claim 4, wherein the housing further comprises a housing bleed orifice providing restricted fluid communication between the internal suction region and the bleed cavity.

6. A compressor in accordance with claim 5, wherein the piston further comprises a piston bleed orifice providing restricted fluid communication between the external suction region and the bleed cavity.

7. A compressor in accordance with claim 4, wherein the suction shutoff valve further comprises a spring arranged to bias the piston towards increasing the variable restriction.

8. A compressor in accordance with claim 4, wherein the second face area is smaller than the first face area for reducing the closing force relative to the opening force.

* * * * *